US007553148B2

(12) United States Patent
Takamatsu et al.

(10) Patent No.: US 7,553,148 B2
(45) Date of Patent: Jun. 30, 2009

(54) PRODUCTION APPARATUS AND PRODUCTION METHOD FOR PRODUCING BENT PORTION OF MULTI-CHANNEL TUBE

(75) Inventors: Yoshikazu Takamatsu, Sano (JP); Hiromi Takasaki, Sano (JP); Susumu Satou, Gunma (JP)

(73) Assignee: Calsonic Kansei Corporation, Tokyo (JP)

( * ) Notice: Subject to any disclaimer, the term of this patent is extended or adjusted under 35 U.S.C. 154(b) by 752 days.

(21) Appl. No.: 11/019,663

(22) Filed: Dec. 23, 2004

(65) Prior Publication Data

US 2005/0156355 A1 Jul. 21, 2005

(30) Foreign Application Priority Data

Dec. 26, 2003 (JP) ..... 2003-435020

(51) Int. Cl.
*B29C 53/08* (2006.01)
*B21D 9/07* (2006.01)

(52) U.S. Cl. ..... 425/393; 425/383; 425/392; 425/328; 425/467; 72/150; 72/283; 72/284; 72/369; 264/339

(58) Field of Classification Search ..... 425/392, 425/393, 325, 328, 380, 381, 383, 466, 467; 72/150, 369, 149, 152, 154, 155, 157, 159, 72/214, 215, 219, 283, 284, 289, 367.1, 370.04, 72/370.05; 264/339
See application file for complete search history.

(56) References Cited

U.S. PATENT DOCUMENTS 3,709,020 A * 1/1973 Evans ..... 72/283
3,888,617 A * 6/1975 Barnett ..... 425/296
4,009,601 A 3/1977 Shimizu
4,063,441 A * 12/1977 Eaton ..... 72/151
4,065,242 A * 12/1977 Dickey et al. ..... 425/384
4,137,743 A 2/1979 Schwarze
4,380,917 A * 4/1983 Uchida et al. ..... 72/17.2
4,432,123 A * 2/1984 Minning et al. ..... 29/890.036
4,481,803 A * 11/1984 Dieser ..... 72/150

(Continued)

FOREIGN PATENT DOCUMENTS

DE 27 32 046 A1 2/1979

(Continued)

OTHER PUBLICATIONS

U.S. Appl. No. 11/019,662, filed Dec. 23, 2004, Takamatsu et al.

*Primary Examiner*—Steven P Griffin
*Assistant Examiner*—Seyed M Malekzadeh
(74) *Attorney, Agent, or Firm*—Foley & Lardner LLP

(57) ABSTRACT

A production apparatus for bending a multi-channel tube having an outer tube and a partition partitioning an interior of the outer tube into two or more channel holes is provided with a bending mold configured to bend the multi-channel tube in a bend radius; a pressure mold configured to press the multi-channel tube toward the bending mold; a chuck portion configured to hold and draw the multi-channel tube along the bending mold; and mandrels respectively inserted into the channel holes, each of the mandrels including; a mandrel body configured to support inner surfaces of each channel hole; a support device rotatably and movably supporting the mandrel body.

5 Claims, 10 Drawing Sheets

U.S. PATENT DOCUMENTS

| | | | | | |
|---|---|---|---|---|---|
| 4,779,436 | A | * | 10/1988 | Schwarze | 72/31.04 |
| 4,916,952 | A | * | 4/1990 | Thielmann et al. | 72/466 |
| 5,036,692 | A | * | 8/1991 | Tasaki et al. | 72/150 |
| 5,214,950 | A | * | 6/1993 | Grobbenhaar | 72/150 |
| 5,284,041 | A | * | 2/1994 | Christensen et al. | 72/159 |
| 5,290,166 | A | * | 3/1994 | Heatherly | 425/173 |
| 5,343,725 | A | * | 9/1994 | Sabine | 72/155 |
| 5,424,015 | A | * | 6/1995 | Matsuda et al. | 264/130 |
| 5,632,176 | A | * | 5/1997 | Bhandari | 72/150 |
| 5,823,031 | A | * | 10/1998 | Campbell et al. | 72/58 |
| 5,860,307 | A | * | 1/1999 | Nakano et al. | 72/133 |
| 5,937,686 | A | * | 8/1999 | Arai | 72/150 |
| 6,009,737 | A | * | 1/2000 | Bandy | 72/150 |
| 6,155,091 | A | * | 12/2000 | Hayes et al. | 72/150 |
| 6,189,354 | B1 | * | 2/2001 | Spath | 72/31.07 |
| 6,346,211 | B1 | * | 2/2002 | Rafferty et al. | 264/573 |
| 7,131,313 | B2 | * | 11/2006 | Nakazato | 72/369 |
| 7,171,835 | B2 | * | 2/2007 | Nakazato | 72/150 |
| 7,360,385 | B1 | * | 4/2008 | Wohlenhaus et al. | 72/150 |
| 2004/0011106 | A1 | * | 1/2004 | Hatano | 72/150 |
| 2004/0154366 | A1 | * | 8/2004 | Schule | 72/149 |
| 2005/0150268 | A1 | * | 7/2005 | Coop | 72/157 |
| 2005/0210946 | A1 | * | 9/2005 | Cappello et al. | 72/150 |

FOREIGN PATENT DOCUMENTS

| | | | |
|---|---|---|---|
| EP | 0 406 969 | A1 | 1/1991 |
| EP | 0 593 241 | A1 | 4/1994 |
| FR | 2 407 764 | | 6/1979 |
| GB | 2 008 453 | A | 6/1979 |
| JP | 64-6465 | Y2 | 2/1989 |
| JP | 2002-5379 | A | 1/2002 |
| JP | 2003-334617 | A | 11/2003 |

* cited by examiner 25
24
22
22
21
21
11
11
19
19
20a
20a
21a
21a 20
21
21
20
19
19

PRODUCTION APPARATUS AND PRODUCTION METHOD FOR PRODUCING BENT PORTION OF MULTI-CHANNEL TUBE

This application claims priority of Japanese Patent Application 2003-435020, filed Dec. 26, 2003. The entire contents of the aforementioned application is incorporated herein by reference.

BACKGROUND OF THE INVENTION

1. Field of the Invention

The present invention relates to a production apparatus and a production method for producing a bent portion of a multi-channel tube, which is provided with partitions therein so that plural flows may pass therethrough.

2. Description of the Related Art

For conducting fluids, various types of pipes are utilized in various machines. Japanese Utility Model Patent Examined Publication No. 64-006465 discloses an art for combining plural pipes into a multi-channel tube.

Such pipes utilized in machines are often bent in certain necessities. In a case of single-hole pipes, bending is not a troublesome work. A mandrel is inserted into a pipe so as to prevent unfavorable deformation and then smooth bending can be achieved. However, in a case of the multi-channel tubes, bending may be often troublesome since the mandrel is not fully effective to prevent unfavorable deformation. For example, partitions inside of the multi-channel tube may unfavorably deform and, in certain cases depending on a bending direction, even an outer wall thereof may deform in a denting or rumpling shape.

SUMMARY OF THE INVENTION

The present invention is intended for providing an apparatus and a method for bending a multi-channel tube without unfavorable deformation.

According to a first aspect of the present invention, a production apparatus for bending a multi-channel tube having an outer tube and a partition partitioning an interior of the outer tube into two or more channel holes is provided with a bending mold configured to bend the multi-channel tube in a bend radius; a pressure mold configured to press the multi-channel tube toward the bending mold; a chuck portion configured to hold and draw the multi-channel tube along the bending mold; and mandrels respectively inserted into the channel holes, each of the mandrels including; a mandrel body configured to support inner surfaces of each channel hole; a support device rotatably and movably supporting the mandrel body.

Preferably, in the production apparatus, each of the mandrel bodies is provided with a proximal portion having a cross sectional shape fitting with a cross sectional shape of the channel hole and a curved surface portion and a flat surface portion, a relief bevel continuing with a distal end of the curved surface portion and being configured to avoid interference with the inner surfaces of the channel holes and a buckling prevention surface continuing with a distal end of the flat surface portion and being configured to contact the partition so as to prevent buckling deformation of the partition.

More preferably, in the production apparatus, the support device is provided with a connection rod for supporting the proximal portion and a fixation portion rotatably supporting the connection rod.

Further preferably, in the production apparatus, the flat surface portion is provided with relief flanks formed by being diagonally and obliquely cut off from both sides of a proximal end of the flat surface portion and configured to avoid interference with the twisted partition.

Still preferably, in the production apparatus, the multi-channel tube is processed to be twisted in advance of bending.

According to a second aspect of the present invention, a production method for bending a multi-channel tube having an outer tube and a partition partitioning an interior of the outer tube into two or more channel holes is provided with inserting mandrel bodies of mandrels respectively into the channel holes of the multi-channel tube; pressing the multi-channel tube toward a bending mold so as to bend the multi-channel tube in a predetermined bend radius; and supporting inner surfaces of the channel holes in the course of bending by moving the mandrel bodies of the mandrels in the channel holes.

BRIEF DESCRIPTION OF THE DRAWINGS

FIG. 2B is a top view, FIG. 2D is a front view and FIGS. 2A and 2C are side views;

FIG. 8A shows only the bending mold and he pressure mold, FIG. 8B shows the multi-channel tube interposed therebetween in a sate that a partition of the pipe is substantially aligned with the joint surface and FIG. 8C shows the multi-channel tube in a state that the partition is disposed closer to the bending mold with respect to the joint surface;

FIG. 9 is a top view, FIG. 10 is a front view, FIG. 11 is a side view and FIG. 12 is a perspective view;

DETAILED DESCRIPTION OF THE PREFERRED EMBODIMENT

The present invention will be described by reference to certain embodiments and accompanying drawings. In the following description, directions are defined as follows: distal as left of FIG. 1 and proximal as right of FIG. 1.

1st Embodiment

A first embodiment of the present invention will be described hereinafter with reference to FIGS. 1 through 8A.

Figure 1:
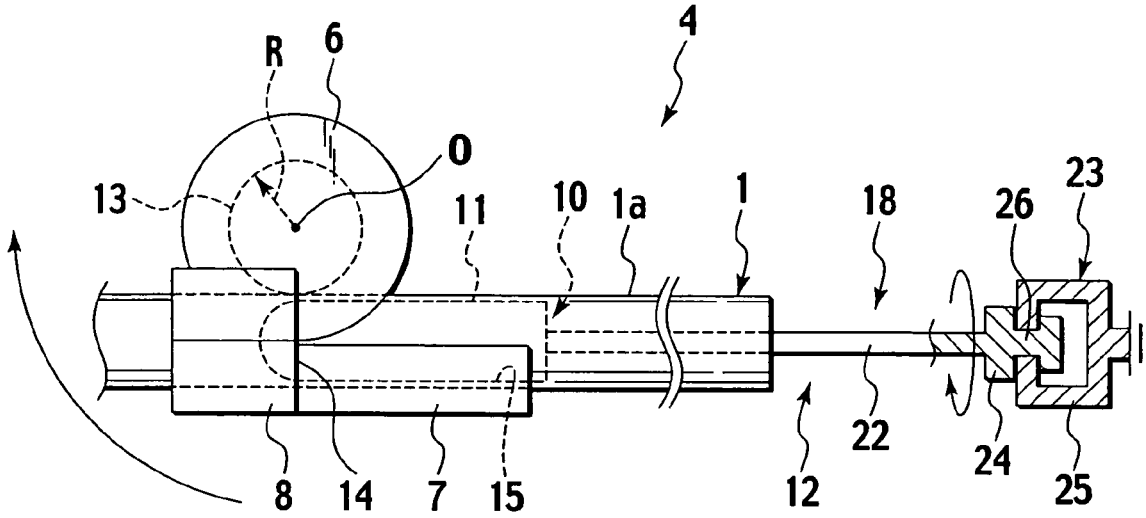
FIG. 1 is a side view of a production apparatus and a multi-channel tube according to a first embodiment of the present invention.
Figure 2A:
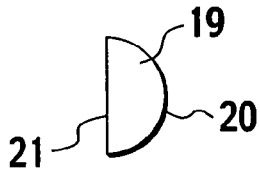
FIGS. 2A through 2D show a mandrel for the production apparatus, where
Figure 2B:
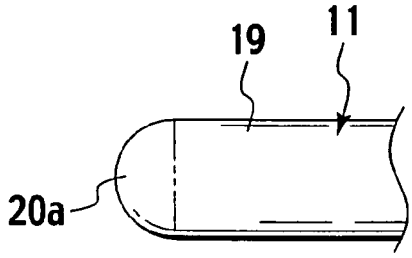
Figure 2C:
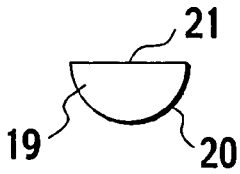
Figure 2D:
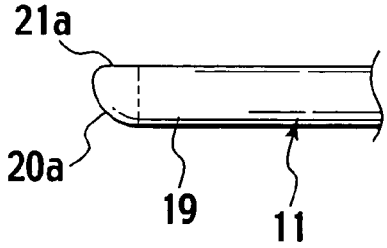

A production apparatus 4 according to the present embodiment of the present invention is preferably applied to bending a multi-channel tube. Such multi-channel tube 1 is provided with a partition 2 integrally formed therewith so as to partition the interior thereof into two channel holes 3. The production apparatus 4 is provided with a bending mold 6, a pressure mold 7, a chuck portion 8 and mandrels 10 as shown in FIG. 1. The bending mold 6, to which an outer periphery 1*a* of the multi-channel tube 1 is pressed, is applied to bending the multi-channel tube 1 in a bend radius R to form a bent portion 5. The pressure mold 7 is applied to applying pressure to the multi-channel tube 1 toward the bending mold 6. The chuck portion 8 holds and draws the multi-channel tube 1 along the bending mold 6. The mandrels 10 are respectively inserted into and support the channel holes 3 of the multi-channel tube 1.

Figure 5:
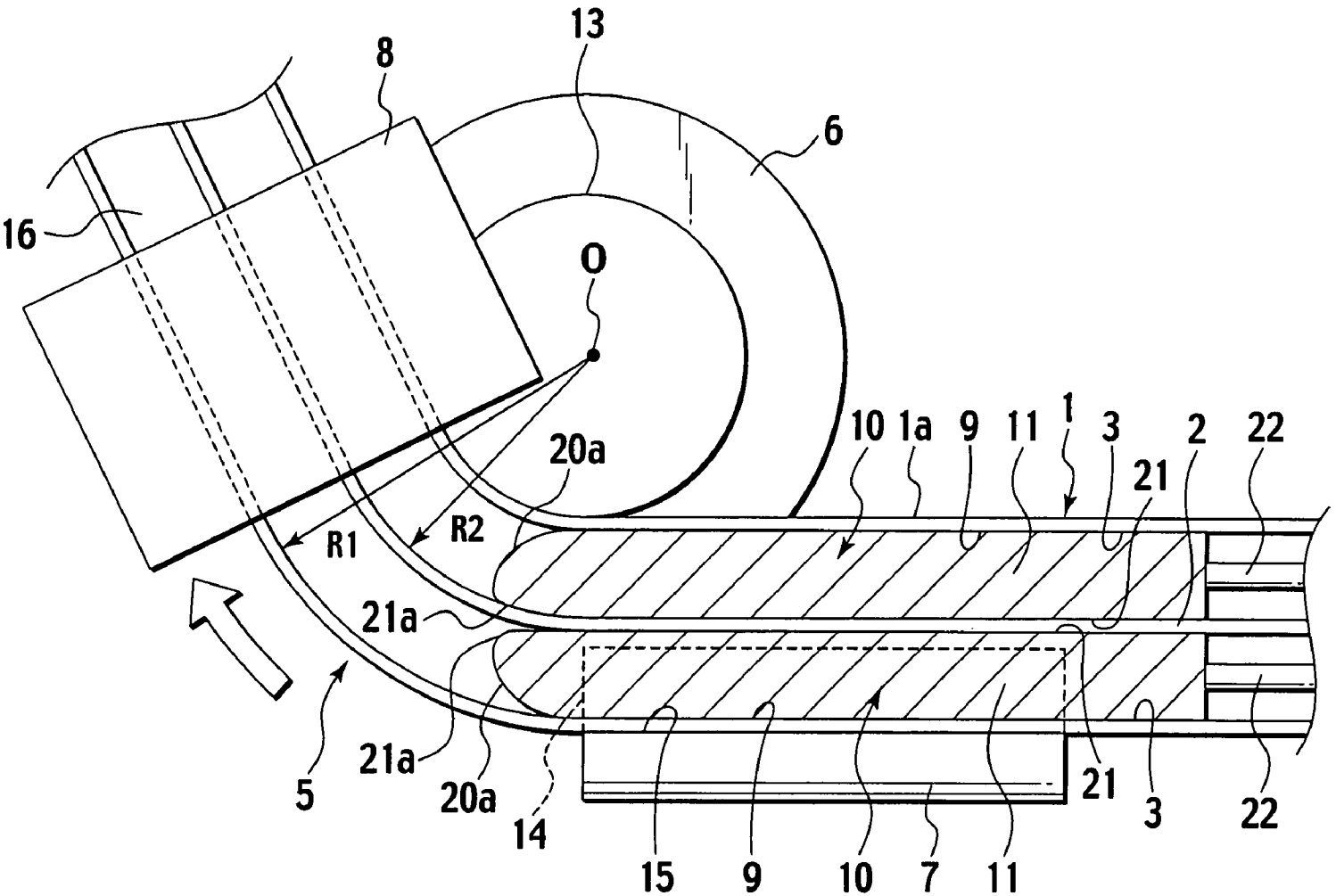
FIG. 5 is across sectional view of a bending mold, a pressure mold, a multi-channel tube and the mandrel showing a state of bending the multi-channel tube.

The bending mold 6 is formed in a low-profile cylinder shape having a mold surface 13 as shown in FIGS. 1 and 5, where a reference O denotes a center of the bending mold 6. The mold surface 13 is a semi-round groove formed around a peripheral surface of the bending mold 6 so as to fit an outer surface of the multi-channel tube 1. A depth of a deepest point of the mold surface 13 from the peripheral surface of the bending mold 6 is substantially a half of a diameter of the multi-channel tube 1. The outer surface of the multi-channel tube 1 is pressed onto the bending mold 6 by the pressure mold 7 when bending is performed.

The pressure mold 7 is formed in a rectangular parallelepiped shape. The pressure mold 7 is disposed along a feeding way, where the multi-channel tube 1 is fed toward the bending mold 6 and ranges from a start point 14 of bending to a proximal part thereof. A side of the pressure mold 7, likewise with the bending mold 6, has a mold surface 15 formed as a semi-round groove so as to fit the outer surface of the multi-channel tube 1. A depth of a deepest point of the mold surface 15 is likewise substantially a half of the diameter of the multi-channel tube 1. The combination of the mold surfaces 13 and 15 hold the multi-channel tube 1 and the pressure mold 7 presses the multi-channel tube 1 toward the bending mold 6.

The chuck portion 8 is configured to hold the multi-channel tube 1 at an end part 16 thereof, where bending ends, and swing around the center O. In the course of swinging, the chuck portion 8 keeps pressing the multi-channel tube 1 toward and along the mold surface 13 of the bending mold 6 so that the multi-channel tube 1 is bent to form the bent portion 5 with a bend radius R which is determined by a radius of the bending mold 6.

Each mandrel 10 is provided with a mandrel body 11 and a support device 12 as shown in FIG. 1. The mandrel body 11 supports an inner surface 9 of the channel hole 3 when the multi-channel tube 1 is bent. The support device 12 supports the mandrel body 11 in a manner that the mandrel body 11 can move with movement of the inner surface 9.

The mandrel body 11 is provided with a proximal portion 19 shaped in a substantially half-columnar shape, across section of which is semicircular and substantially identical to a corresponding cross section of the channel hole 3. The proximal portion 19 is provided with a curved surface portion 20, which contacts the inner surface 9 of the channel hole 3, and a flat surface portion 21, which contacts the partition 2 of the multi-channel tube 1. A distal end of the mandrel body 11 is provided with a relief bevel 20*a*, which is a round surface continuing with the curved surface portion 20, and a buckling prevention surface 21*a*, which is a round surface continuing with the flat surface portion 21. A curvature radius of the relief bevel 20*a* is smaller than a radius R1 of curvature of the inner surface 9 of the channel hole 3 just bending at a distal side with respect to the start point 14 of bending (see FIG. 5) and hence the relief bevel 20*a* is configured to avoid interference with bending. A curvature radius of the buckling prevention surface 21*a* is smaller than a radius R2 of curvature of the inner surface of the partition 2. The buckling prevention surface 21*a* is configured to contact the partition 2 so as to prevent buckling deformation thereof. The mandrel body 11 is rotatably supported by the support device 12.

Figure 3:
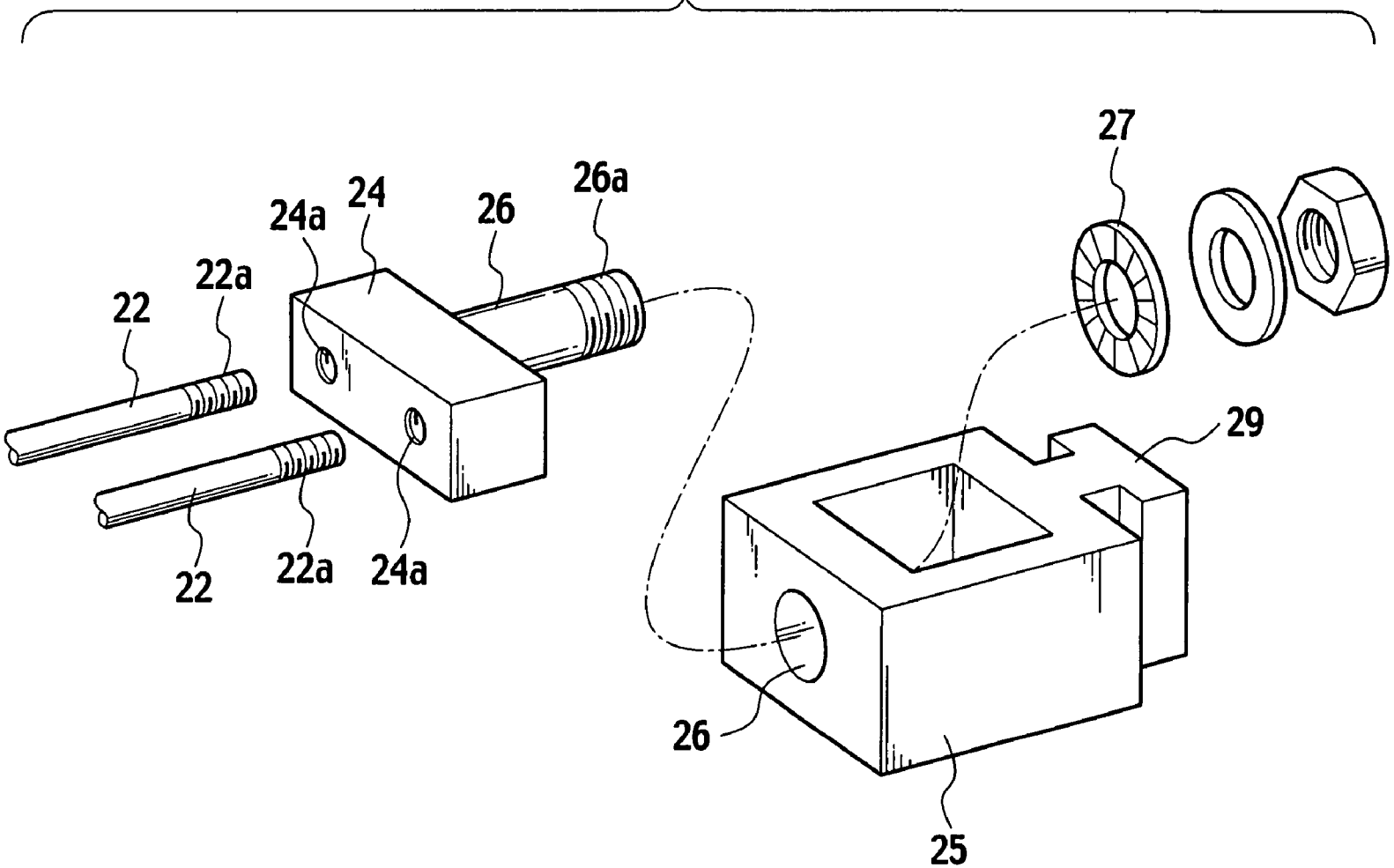
FIG. 3 is an exploded perspective view of supporting means for supporting the mandrel.
Figures 4A, 4B:
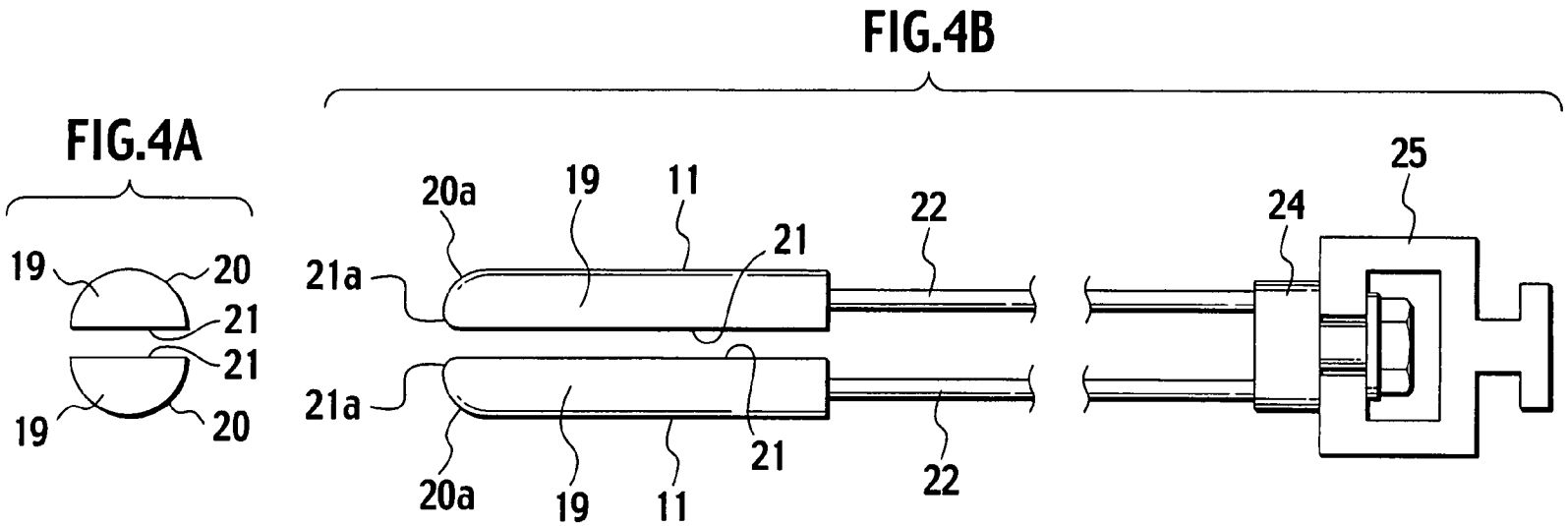
FIGS. 4A and 4B are respectively a side view and a front view of the mandrel and the supporting means.

The support device 12 is provided with a pair of connection rods 22 respectively supporting the proximal portions 19, a fixation portion 23 rotatably supporting the connection rods 22 as shown in FIGS. 3 and 4. The fixation portion 23 is provided with a rotatable block 24, with which the connection rods 22 are connected, and a fixed block 25 rotatably supporting the rotatable block 24. A distal end of the rotatable block 24 has a pair of screw holes 24*a*, to which screw portions 22*a* formed at ends of the connection rods 22 are respectively screwed, and a proximal end has a pivotal projection 26, which is connected with the fixed block 25 having a bearing 27 interposed therebetween.

The fixed block 25 is formed in a box-like shape and has a through hole 28, to which the pivotal projection 26 is inserted, at a distal end thereof and a fixation projection 29 at a proximal end thereof. The fixation projection 29 is applied to fixation of the fixed block with an apparatus (not shown).

A production method for producing a bent portion of the multi-channel tube 1 will be described hereinafter.

Figure 6A:
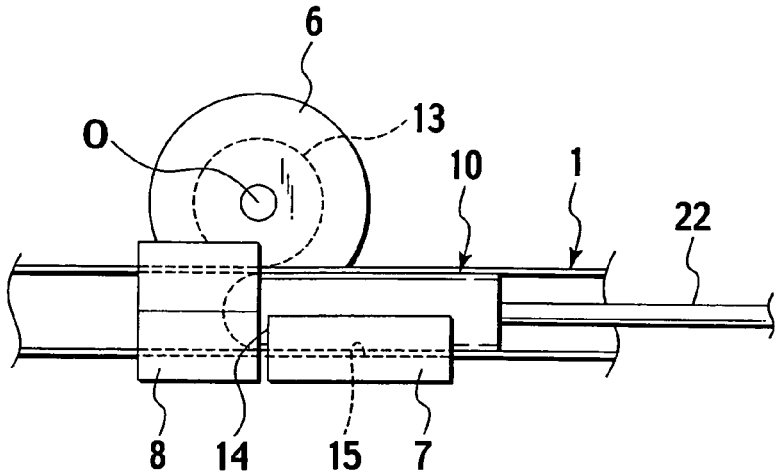
FIGS. 6A through 6C show a process of bending the multi-channel tube in the order of process steps.

First, as shown in FIG. 6A, the multi-channel tube 1 in a straight form is put on the mold surface 13 of the bending mold 6 and pressed toward the mold surface 13 by means of the pressure mold 7. At the same time, the pressure mold 7 supports the proximal part through the start point 14 of the multi-channel tube 1. The chuck portion 8 supports the end part 16 through the start point 14 of the multi-channel tube 1.

Figure 6B:
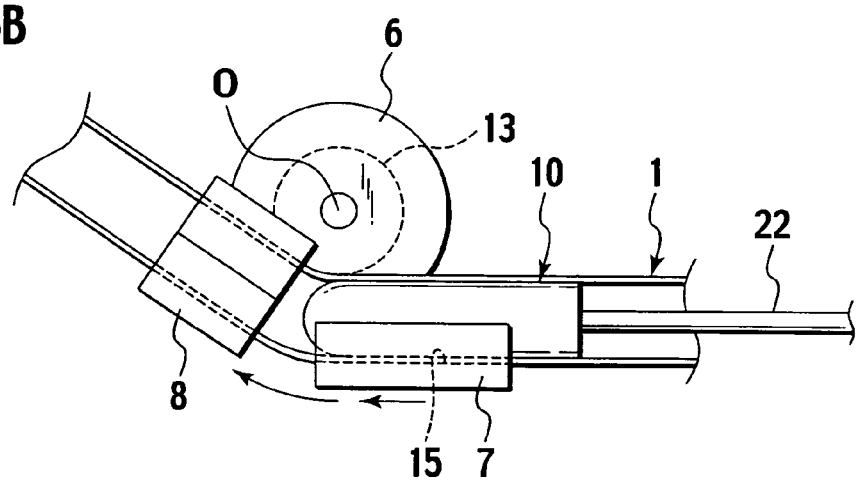

Next, as shown in FIG. 6B, the chuck portion 8 moves from the start point 14 toward a distal part of the multi-channel tube 1 and rotates around the center O so as to press the multi-channel tube 1 along the bending mold 6. In the course of this, the pressure mold 7 also moves toward the distal direction.

Then, as shown in FIG. 5, the multi-channel tube 1 starts bending. Compression stress and tensile stress are generated at inside and outside thereof, respectively, and hence the inner surfaces 9 of the respective channel holes 3 tend to locally deform. However, the curved surface portions 20 and the flat surface portions 21 contact and support the inner surfaces 9 and surfaces of the partition 2 and prevent their partial deformation. Though the surfaces extends or contract according to bending, the mandrel bodies 11 of the mandrels 10 can follow these movement since the mandrel bodies 11 are rotatably supported. Therefore prevention of such partial deformation is constantly assured.

Figure 6C:
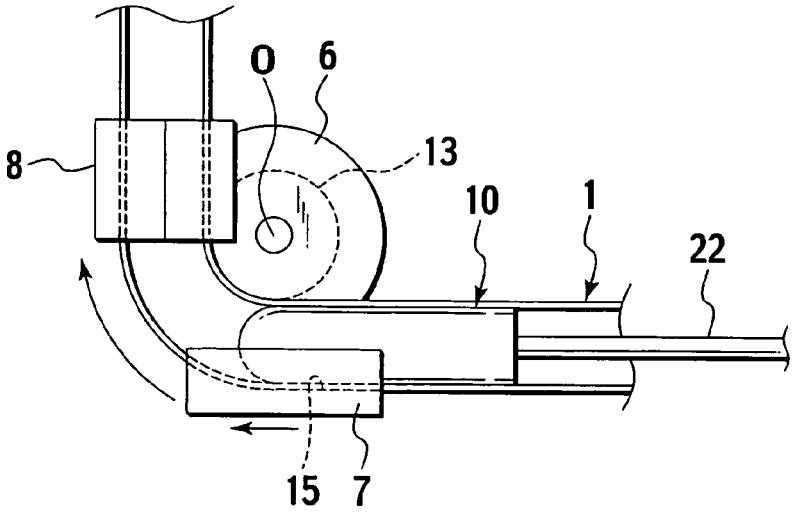

Finally, as shown in FIG. 6C, the chuck portion 8 rotates in 90 degrees with respect to the initial position, thereby the multi-channel tube 1 is substantially perpendicularly bent.

As being understood from the above description, the mandrels 10 are utilized to bend the multi-channel tube 1 without partial deformation.

Figure 7A:
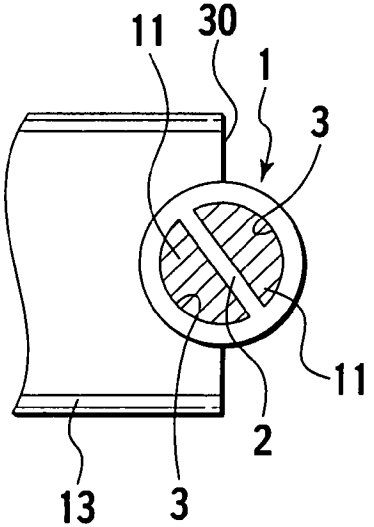
FIGS. 7A through 7D show various states of the multi-channel tube fitted between the bending mold and the pressure mold.
Figure 7B:
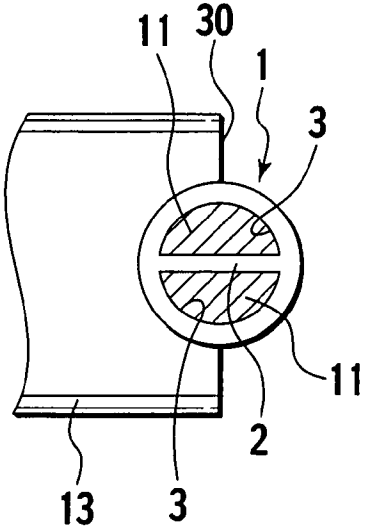
Figure 7C:
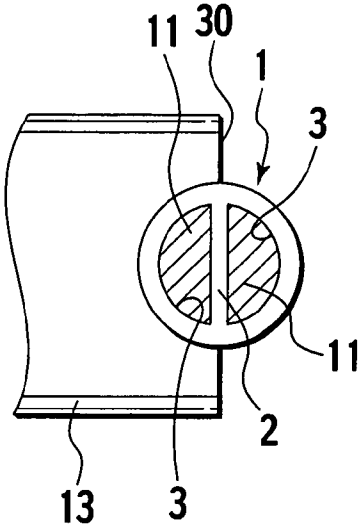
Figure 7D:
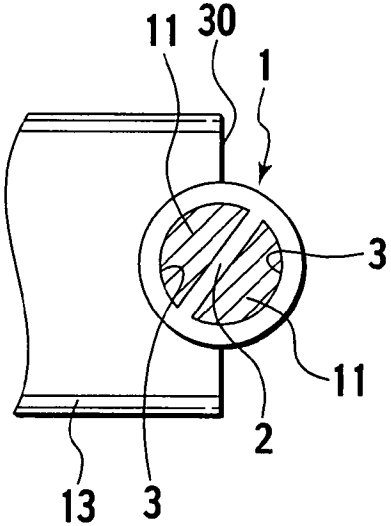

Bending of the multi-channel tube 1 may be performed in various states in view of a direction thereof. FIGS. 7A through 7D show such various states. FIGS. 7A and 7D show states that the partition 2 is inclined with respect to a joint surface 30 between the molds 6 and 7. FIG. 7B shows a state that the partition 2 is perpendicular to the joint surface 30. FIG. 7C shows a state that the partition 2 is parallel to the joint surface 30. The present embodiment of the present invention is effectively applied to any state of FIGS. 7A, 7B, 7C and 7D, since the mandrels 10 can rotate in any direction.

Figure 8A:
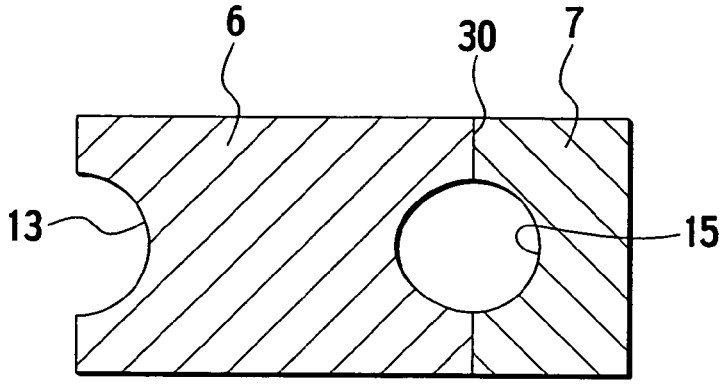
FIGS. 8A through 8C show states of engagement of the bending mold, the pressure mold and the multi-channel tube, where
Figure 8B:
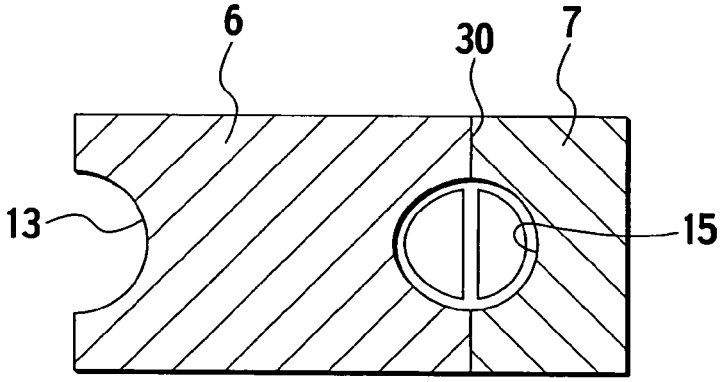
Figure 8C:
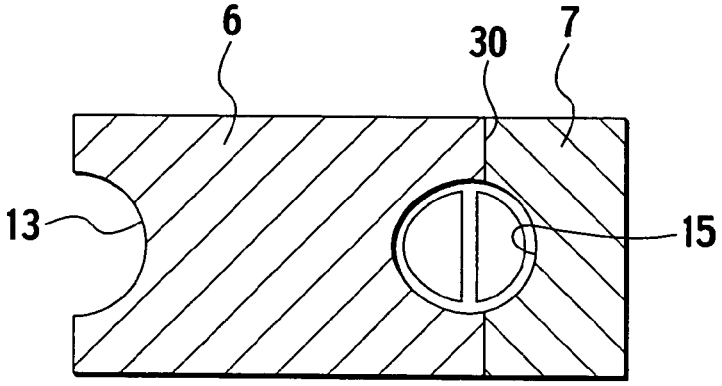
Figure 9:
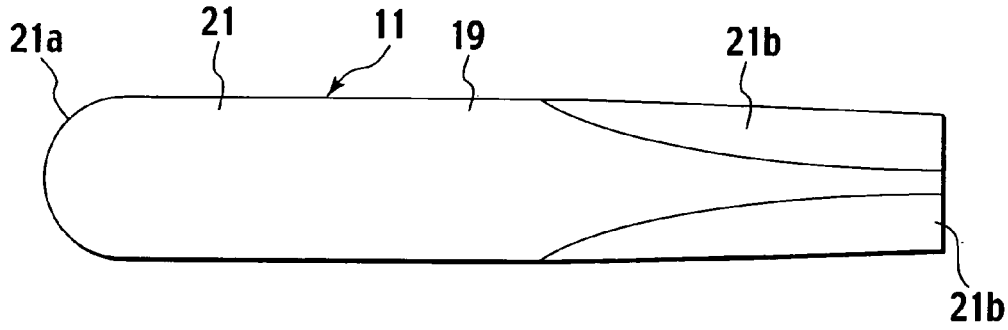
FIGS. 9 through 12 show a mandrel for a production apparatus according to a second embodiment of the present invention, where
Figure 10:
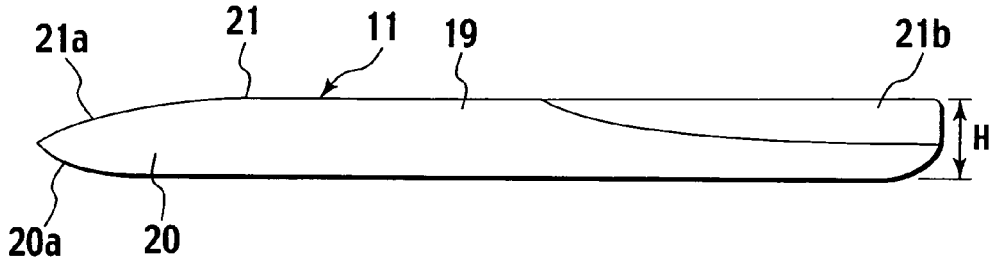
Figure 11:
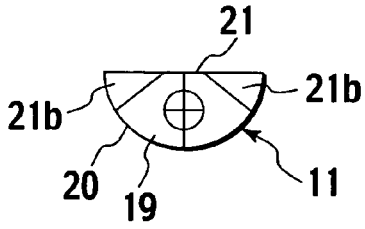
Figure 12:
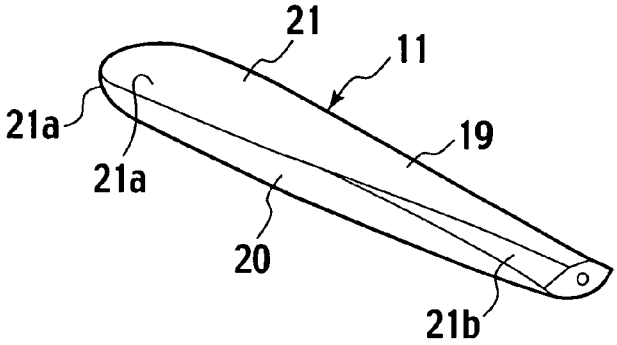
Figure 13:
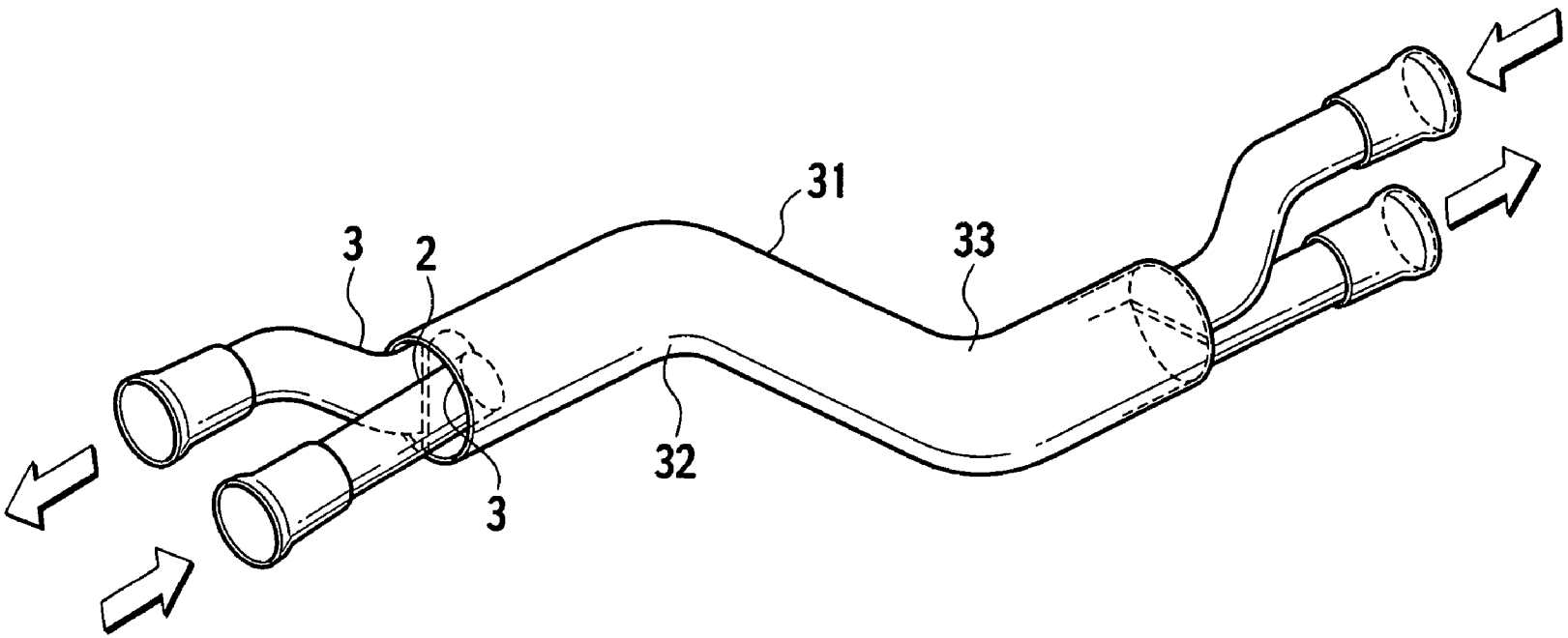
FIG. 13 is a perspective view of a multi-channel tube and branching tubes connected therewith, which is bent by using the production apparatus according to the second embodiment of the present invention.

According to the aforementioned description, the depth of the deepest point of the bending mold 6 is substantially a half of a diameter of the multi-channel tube 1 as shown in FIGS. 8A and 8B. However, the partition may be disposed closer to the bending mold with respect to the joint surface 30. In this case, the outer surface of the multi-channel tube 1 is free from damage since the partition 2 is definitely housed in the groove of the bending mold 6 and then bent.

2nd Embodiment

A second embodiment of the present invention will be described hereinafter with reference to FIGS. 9 through 14. In these drawings and the following description, substantially the same elements as the aforementioned first embodiment are referenced with the same numerals.

A multi-channel tube 31 is provided with a partition 2 integrally formed therewith so as to partition the interior thereof into two channel holes 3. The multi-channel tube 31 is bent to form bent portions 32 and 33 by using a production apparatus 4 and twisted in 90 degrees around a central axis thereof. Such processed multi-channel tube 31 is preferably applied to an engine room of a vehicle, in which a space for laying tubes is limited and hence three-dimensional layout thereof is required.

The production apparatus 4 according to the second embodiment of the present invention is substantially identical to one according to the aforementioned first embodiment, however, constitutions of mandrel bodies 11 are modified as shown in FIGS. 9 through 13.

Each of the mandrel bodies 11 is provided with a proximal portion 19 shaped in a substantially half-columnar shape, across section of which is semicircular and substantially identical to a corresponding cross section of the channel hole 3. The proximal portion 19 is provided with a curved surface portion 20, which contacts the inner surface 9 of the channel hole 3, and a flat surface portion 21, which contacts the partition 2 of the multi-channel tube 1. A distal end of the mandrel body 11 is provided with a relief bevel 20*a*, which is a round surface continuing with the curved surface portion 20, and a buckling prevention surface 21*a*, which is a round surface continuing with the flat surface portion 21. Both sides of a proximal end of the flat surface portion 21 are diagonally and obliquely cut off to form a pair of relief flanks 21*b*. The relief flanks 21*b* are so dimensioned, with respect to lengths, widths and angles from the flat surface portion 21, as to allow movement of the mandrel body 11 relative to the twisted partition 2 without frictional interference or catching therebetween.

The production apparatus 4 can be applied to a process for forming the multi-channel tube 31 from a straight multi-channel tube by bending and twisting. In a step of bending, the curved surface portions 20 contact and support the inner surfaces 9 and prevent partial deformation thereof. Moreover, the flat surface portions 21 contact and support the surfaces of the partition 2 and the buckling prevention surfaces 21 contact and support the bending partition 2, thereby partial deformation of the partition 2 is prevented. Furthermore, the relief flanks 21*b* prevents interference with the twisted partition 2.

The proximal end of the proximal portion 19 secures enough height H to contact both the partition 2 and the inner surface 9 though both sides thereof are cut off, thereby the partition 2 around the proximal end is also prevented from partial deformation.

In a case of forming the multi-channel tube 31 from a straight multi-channel tube by bending and twisting, the mandrel bodies 11 inserted into the multi-channel tube 31 movably contact and support the inner surfaces 9 of the channel holes 3. Thereby bent portions 32 and 33 of the multi-channel tube 31 are formed in preferably regular shapes.

Figure 14:
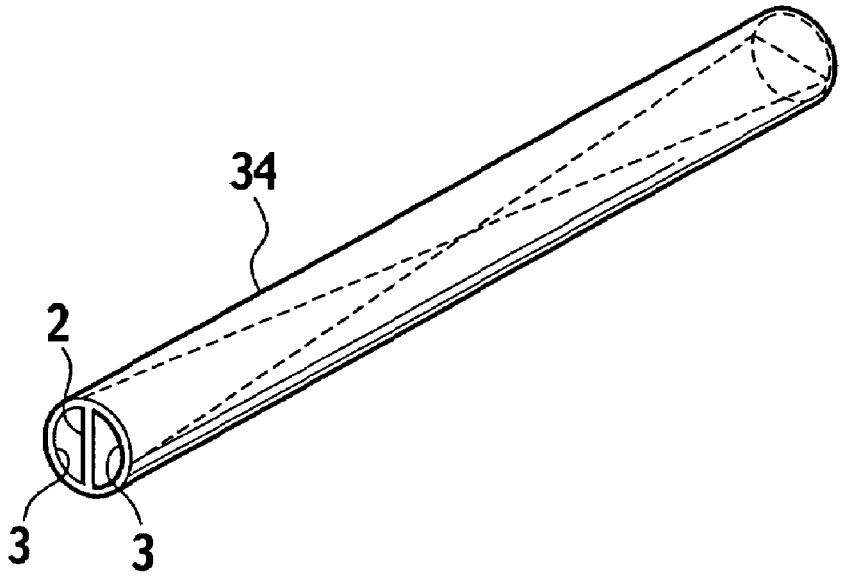
FIG. 14 is a perspective view of a twisted multi-channel tube formed by an extrusion forming.

The production apparatus 4 according to the present second embodiment of the present invention can be applied to forming the multi-channel tube 31 by simultaneous bending and twisting as mentioned above, however, the production apparatus 4 can be applied to simple bending of a pre-twisted multi-channel tube. The pre-twisted multi-channel tube can be formed by either extrusion forming as shown in FIG. 14 or twisting of a straight multi-channel tube. In either case, precise twisting angle thereof can be pursued as compared with the case of simultaneous bending and twisting.

3rd Embodiment

A third embodiment of the present invention will be described hereinafter with reference to FIG. 15. In the drawing and the following description, substantially the same elements as any of the first and second embodiments are reference with the same numerals.

Figure 15:
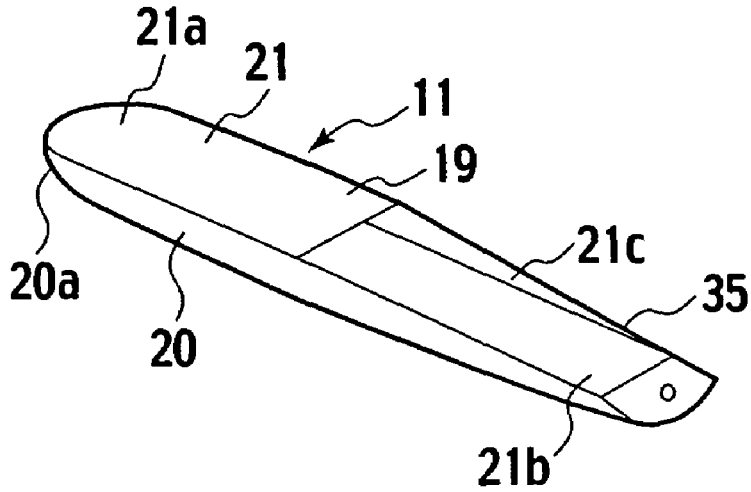
FIG. 15 is a perspective view of a mandrel for a production apparatus according to a third embodiment of the present invention.

The production apparatus 4 according to the third embodiment of the present invention is substantially identical to one according to the first and second embodiments, however, constitutions of mandrel bodies 11 are modified as shown in FIG. 15.

Each of the mandrel bodies 11 is provided with a proximal portion 19 shaped in a substantially half-columnar shape, across section of which is semicircular and substantially identical to a corresponding cross section of the channel hole 3. The proximal portion 19 is provided with a curved surface portion 20, which contacts the inner surface 9 of the channel hole 3, and a flat surface portion 21, which contacts the partition 2 of the multi-channel tube 1. A distal end of the mandrel body 11 is provided with a relief bevel 20*a*, which is a round surface continuing with the curved surface portion 20, and a buckling prevention surface 21*a*, which is a round surface continuing with the flat surface portion 21. Both sides of a proximal end of the flat surface portion 21 are diagonally and obliquely cut off to form a pair of relief flanks 21*c*. The relief flanks 21*c* are so dimensioned, with respect to lengths, widths and angles from the flat surface portion 21, as to allow movement of the mandrel body 11 relative to the twisted partition 2 without frictional interference or catching therebetween. Moreover, relief angles of the relief flanks 21*c* with respect to the flat surface portion 21 gradually increase from a distal end thereof toward a proximal end thereof, namely, the relief flanks 21*c* respectively have twisted surfaces.

The production apparatus 4 can be applied to a process for forming the multi-channel tube 31 from a straight multi-channel tube by bending and twisting. In a step of bending, the curved surface portions 20 contact and support the inner surfaces 9 and prevent partial deformation thereof. Moreover, the flat surface portions 21 contact and support the surfaces of the partition 2 and the buckling prevention surfaces 21 contact and support the bending partition 2, thereby partial deformation of the partition 2 is prevented. Furthermore, the relief flanks 21*c* movably fit and support the twisted partition 2 and prevents interference with the twisted partition 2.

The proximal end of the proximal portion 19 secures enough height H to contact both the partition 2 and the inner surface 9 though both sides thereof are cut off, thereby the partition 2 around the proximal end is also prevented from partial deformation.

In a case of forming the multi-channel tube 31 from a straight multi-channel tube by bending and twisting, the mandrel bodies 11 inserted into the multi-channel tube 31 movably contact and support the inner surfaces 9 of the channel holes 3. Thereby bent portions 32 and 33 of the multi-channel tube 31 are formed in preferably regular shapes.

The production apparatus 4 according to any of the aforementioned embodiments of the present invention is preferably applied to forming a bent multi-channel tube for an engine room of a vehicle, in which a space for laying tubes is limited and hence three-dimensional layout thereof is required.

Although the invention has been described above by reference to certain embodiments of the invention, the invention is not limited to the embodiments described above. Modifications and variations of the embodiments described above will occur to those skilled in the art, in light of the above teachings.

What is claimed is:

1. A production apparatus for bending a multi-channel tube having an outer tube and a partition partitioning an interior of the outer tube into two or more channel holes, the production apparatus comprising:

a bending mold configured to bend the multi-channel tube in a bend radius;

a pressure mold configured to press the multi-channel tube toward the bending mold;

a chuck portion configured to hold and draw the multi-channel tube along the bending mold; and a plurality of mandrels respectively inserted into the channel holes, each of the mandrels including:

a mandrel body configured to support inner surfaces of each channel hole; and a support device rotatably and movably supporting the mandrel body, wherein each of the mandrel bodies comprises a proximal portion having a cross sectional shape fitting with a cross sectional shape of the channel hole and including a curved surface portion and a flat surface portion, a relief bevel continuing with a distal end of the curved surface portion and being configured to avoid interference with the inner surfaces of the channel holes and a buckling prevention surface continuing with a distal end of the flat surface portion and being configured to contact the partition so as to prevent buckling deformation of the partition, and wherein the flat surface portion includes relief flanks formed by being diagonally and obliquely cut off from both sides of a proximal end of the flat surface portion and configured to avoid interference with the partition even when the partition is twisted.

2. The production apparatus of claim 1, wherein the support device includes a connection rod for supporting the proximal portion and a fixation portion rotatably supporting the connection rod.

3. A production method used in combination with the production apparatus of claim 1, the production method comprising:

inserting the mandrel bodies of the mandrels respectively into the channel holes of the multi-channel tube;

pressing the multi-channel tube toward the bending mold so as to bend the multi-channel tube in the bend radius; and supporting the inner surfaces of the channel holes so as to prevent unfavorable deformation in the course of bending by moving the mandrel bodies of the mandrels in the channel holes.

4. The production apparatus of claim 1, further comprising:

a rotatable block configured to support the mandrels so as to allow rotation of the mandrels in a group.

5. The production method of claim 3, further comprising:

twisting the multi-channel tube in advance of bending.

* * * * *